US007084844B2

(12) United States Patent
Yeo et al.

(10) Patent No.: US 7,084,844 B2
(45) Date of Patent: Aug. 1, 2006

(54) LIQUID CRYSTAL DISPLAY AND DRIVING METHOD THEREOF

(75) Inventors: Ju Chun Yeo, Kyungsangbuk-do (KR); Seong Gyun Kim, Kyunggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 155 days.

(21) Appl. No.: 09/874,960

(22) Filed: Jun. 7, 2001

(65) Prior Publication Data

US 2001/0050665 A1 Dec. 13, 2001

(30) Foreign Application Priority Data

Jun. 8, 2000 (KR) ..... 2000-31462

(51) Int. Cl.
*G09G 6/36* (2006.01)

(52) U.S. Cl. ..... 345/88; 345/98; 345/100

(58) Field of Classification Search ..... 345/87, 345/88, 89, 98–100, 103, 204, 205, 208, 345/211, 212, 21 R See application file for complete search history.

(56) References Cited

U.S. PATENT DOCUMENTS 5,168,270 A * 12/1992 Masumori et al. ..... 345/100
5,192,945 A * 3/1993 Kusada ..... 340/784
6,097,362 A * 8/2000 Kim ..... 345/87
6,333,729 B1 * 12/2001 Ha ..... 345/98
6,424,328 B1 * 7/2002 Ino et al. ..... 345/87

FOREIGN PATENT DOCUMENTS

KR 2000-0023298 A 4/2000

* cited by examiner

*Primary Examiner*—Regina Liang
*Assistant Examiner*—Jennifer T. Nguyen
(74) *Attorney, Agent, or Firm*—McKenna Long & Aldridge LLP

(57) ABSTRACT

A method of driving a liquid crystal display wherein an application sequence of a data is changed, to thereby improve a picture quality. In the method, the data is supplied to a desired number of data lines on a basis of first sequence in a first horizontal period. The data is supplied to the desired number of data lines on a basis of second sequence in a second horizontal period following the first horizontal period.

17 Claims, 8 Drawing Sheets

LIQUID CRYSTAL DISPLAY AND DRIVING METHOD THEREOF

BACKGROUND OF THE INVENTION

1. Field of the Invention

This invention relates to a liquid crystal display, and more particularly to a liquid crystal display and a driving method wherein an application sequence of a data is changed so as to improve a picture quality.

2. Description of the Related Art

Generally, a liquid crystal display (LCD) uses a pixel matrix arranged in each intersection between gate lines and data lines to thereby display a picture corresponding to video signals. Each pixel consists of a liquid crystal cell controlling a transmitted light quantity in accordance with a video signal, and a thin film transistor (TFT) for switching the video signal to be applied from the data line to the liquid crystal cell.

The LCD is provided with gate and data driving integrated circuits, hereinafter referred to as "D-IC's", for driving the gate lines and the data lines. In this case, a demultiplexor (DEMUX) is connected between the data D-IC so as to simplify a circuit configuration of the LCD.

The DEMUX reduces the required number of data D-IC by connecting any one output line of the data D-IC to a plurality of data lines. For instance, when the number of data lines is n and the number of data lines connected to one DEMUX, the output line number k of data D-IC becomes 'n/m'. In other words, the required number of the data D-IC is reduced to '1/m'. The DEMUX is formed on the same substrate as the pixels upon manufacturing of the LCD.

The data D-IC outputs a data m times for one horizontal period 1H. The data outputted from the data D-IC is applied, via the DEMUX, to the data lines. The DEMUX receives control signals corresponding to the number of data lines allowable to itself so as to sequentially connect a plurality of data lines to one output line of the data D-IC.

Hereinafter, a conventional LCD driving method will be described with reference to FIG. 1 and FIG. 2.

Referring to FIG. 1, there is shown a conventional LCD device including first to kth demultiplexors DEMUX1 to DEMUXk connected to n data lines DL1 to DLn between a data D-IC 12 and a liquid crystal display panel 10. The data D-IC includes k output lines corresponding to the first to kth demultiplexors DEMUX1 to DEMUXk. Each of the k demultiplexors DEMUX1 to DEMUXk is connected to four data lines DL1 to DLn. To this end, each of the demultiplexors DEMUX1 to DEMUXk includes four MOS transistors MN1 to MN4.

The four MOS transistors MN1 to MN4 receive first to fourth control signals CS1 to CS4 from the exterior thereof. The first to fourth control signals CS1 to CS4 are sequentially enabled every horizontal synchronous interval as shown in FIG. 2.

The conventional LCD device further includes a gate D-IC 14 for driving m gate lines GL1 to GLm on the liquid crystal display panel 10. The gate D-IC 14 sequentially applies a gate scanning signal GSS to m gate lines GL1 to GLm for one frame.

The gate scanning signal GSS maintains a high state for one horizontal synchronous interval at a certain gate line GL as shown in FIG. 2. When the gate line GL maintains a high state, the data D-IC 12 sequentially applies four data to each of the demultiplexors DEMUX1 to DEMUXK. At this time, each of the demultiplexors DEMUX1 to DEMUXk responds to the first to fourth control signals CS1 to CS4 supplies four data inputted from the output line of the data D-IC 12 to four data lines.

More specifically, the first demultiplexor DEMUX1 receives four data R1, G1, B1 and R2 from the data D-IC 12 as shown in FIG. 2 and sequentially delivers them to the first and fourth data lines DL1 to DL4. Similarly, the second demultiplexor DEMUX2 receives four data G2, B2, R3 and G3 from the data D-IC 12 and sequentially delivers the same to the fifth to eighth data lines DL5 to DL8.

Such a conventional LCD driving method causes a phenomenon in which a data is distorted due to a coupling capacitor Cs between the data lines. More specifically, as shown in FIG. 3, the fifth data line DL5 receives a green data signal G2 from the first MOS transistor MN1 of the second demultiplexor DEMUX2 in a time interval when the first control signal CS1 has a high state. On the other hand, the fifth data line DL5 becomes a floating state when the first control signal CS1 has a low state. Then, the sixth data line DL6 receives a blue data signal B2 from the second MOS transistor MN2 of the second demultiplexor DEMUX2 in a time interval when the second control signal CS2 has a high state. At this time, a green data signal G2 charged in the fifth data line DL5 is changed due to the coupling capacitor Cc between the fifth and sixth data lines DL5 and DL6.

After the blue data signal B2 was charged in the second data line DL6, the seventh data line DL7 receives a red data signal R3 from the third MOS transistor MN3 of the second demultiplexor DEMUX2 in a time interval when the third control signal CS3 has a high state. At this time, the blue data signal B2 charged in the sixth data line DL6 is changed due to the coupling capacitor Cc between the sixth and seventh data lines DL6 and DL7.

After a red data signal R3 was charged in the seventh data line DL7, the eighth data line DL8 receives the green data signal G3 from the fourth MOS transistor MN4 of the second demultiplexor DEMUX2 in a time interval when the fourth control signal CS4 has a high state. At this time, a red data signal R3 charged in the seventh data line DL7 is changed due to the coupling capacitor Cc between the seventh and eighth data lines DL7 and DL8.

Further, the green data signal G2 charged in a pixel on the fifth data line DL5 is changed when the red data signal R2 is applied to the fourth data line D4. In other words, a data signal received from the first MOS transistor MNI is changed twice by the coupling capacitor while data signals received from the second and third MOS transistors MN2 and MN3 are changed once by the coupling capacitor. On the other hand, a data signal received from the fourth MOS transistor MN4 is not changed. As a result, a conversion frequency of the data signal is differentiated, so that a stripe-shaped distortion is generated at a picture displayed on the liquid crystal display panel 10.

In the conventional LCD driving method, a different leakage current is generated depending on an application sequence of data signals applied to the data lines DL1 to DLn. Such a different leakage current from the data lines DL1 to DLn is caused by a fact that a holding interval is different in accordance with an application sequence of the data signals. In other words, as shown in FIG. 4, a data having the same voltage value is sampled in a state changed into a different absolute voltage value from each pixel. More specifically, the first data line DL1 receives the first red data signal R1 from the first MOS transistor MN1 of the first demultiplexor DEMUX1 in a time interval when the first control signal CS1 has a high state. The first data line DL1 maintains a voltage charged until the falling edge of the gate scanning signal GSS. In other words, a voltage charged in the first data line DL1 is leaked for a long time from the falling edge of the first control signal CS1 until the falling edge of the gate scanning signal GSS. As a result, the first data line DL1 applies a voltage signal lower than the initially received red data signal R1 to the pixel. In other words, a voltage applied to the first data line DL1 is leaked by a voltage ΔV1.

The fourth data line DL4 receives the second red data signal R2 from the fourth MOS transistor MN4 of the first demultiplexor DEMUX1 in a time interval when the fourth control signal CS4 has a high state. The fourth data line DL4 maintains the charged voltage until the falling edge of the gate scanning signal GSS. The voltage charged in the fourth data line DL4 is leaked for a short time from the falling edge of the fourth control signal CS4 until the falling edge of the gate scanning signal GSS. As a result, a voltage applied to the fourth data line DL4 is leaked by a voltage ΔV2. Accordingly, the voltage applied to the fourth data line DL4 becomes higher than the voltage applied to the first data line DL1. For this reason, a picture displayed on the liquid crystal display panel 10 is more distorted to thereby deteriorate a picture quality.

As a result, in the conventional LCD driving method, the same data is supplied to each pixel at a different voltage level to thereby distort a picture displayed on the liquid crystal display panel. Also, since a color data supplied to each data line is changed by the coupling capacitor, a picture distortion phenomenon becomes serious.

SUMMARY OF THE INVENTION

Accordingly, it is an object of the present invention to provide a liquid crystal display and a driving method thereof that allow each data line to have an averagely uniform change frequency of a data signal and a uniform leakage current.

In order to achieve these and other objects of the invention, a method of driving a liquid crystal display according to one aspect of the present invention includes the steps of supplying a data to a desired number of data lines on a basis of first sequence in a first horizontal period; and supplying said data to the desired number of data lines on a basis of second sequence in a second horizontal period following the first horizontal period.

A method of driving a liquid crystal display according to another aspect of the present invention includes the steps of supplying a data to a desired number of data lines on a basis of first sequence in the (4i +1)th and (4i+4)th frames (wherein i is an integer); and supplying said data to the desired number of data lines on a basis of second sequence in the (4i+2)th and (4i+3)th frames.

A liquid crystal display device according to still another aspect of the present invention includes switching devices a desired number of which are included in each demultiplexor and each of which is connected to one data line; and control means for controlling the switching devices such that a data is sequentially distributed to the desired number of data lines in a first horizontal period and such that said data is reverse-sequentially distributed to the desired number of data lines in a second horizontal period following the first horizontal period.

A liquid crystal display device according to still another aspect of the present invention includes switching devices a desired number of which are included in each demultiplexor and each of which is connected to one data line; and control means for controlling the switching devices such that a data is sequentially distributed to the desired number of data lines on a basis of first sequence in the (4i+1)th and (4i+4)th frames (wherein i is an integer) and said data is reverse-sequentially distributed to the desired number of data lines on a basis of second sequence in the (4i+2)th and (4i+3)th frames.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
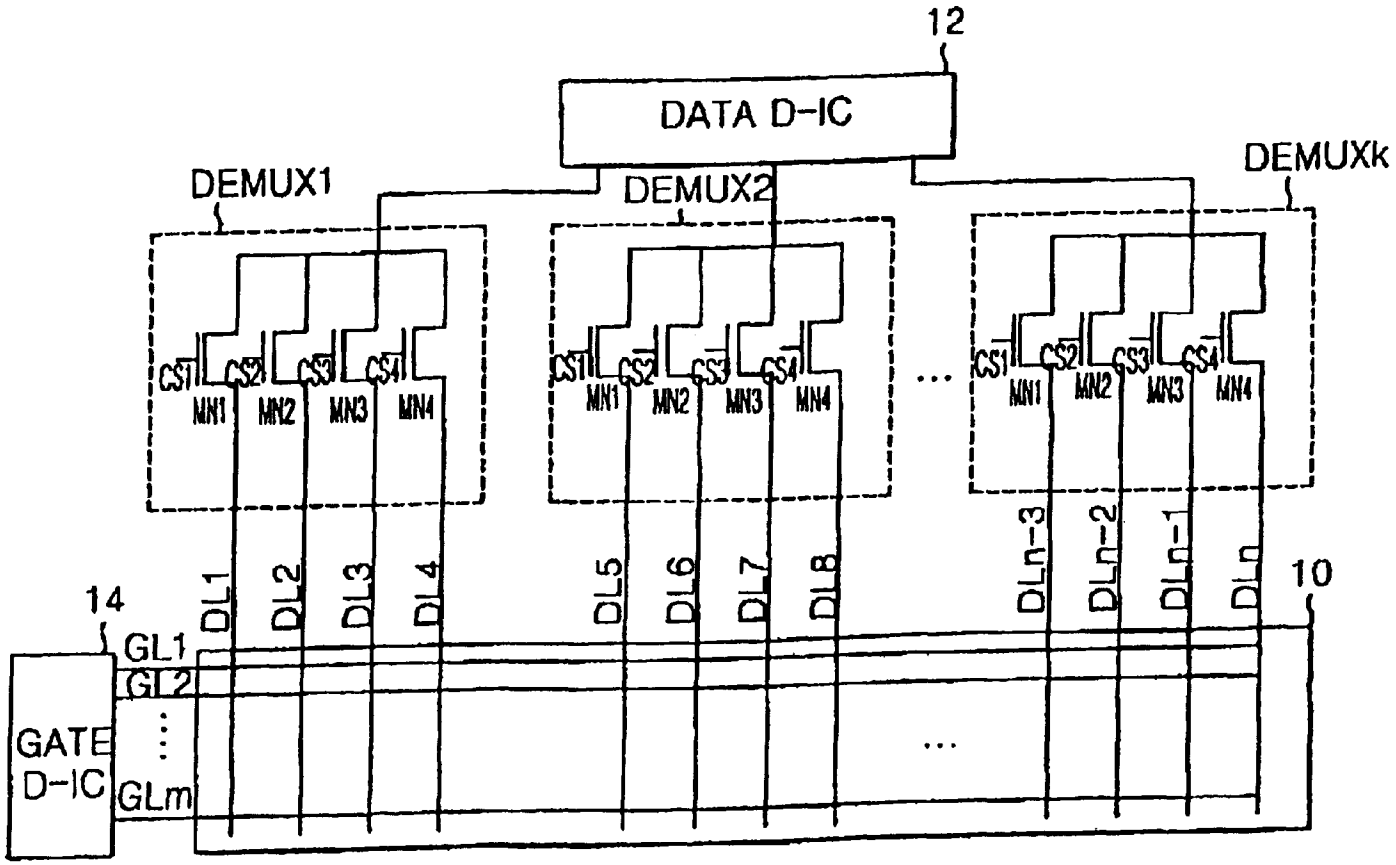
FIG. 1 CONVENTIONAL ART
FIG. 1 is a schematic block circuit diagram showing a configuration of a liquid crystal display driven by a conventional liquid crystal display driving method.
Figure 2:
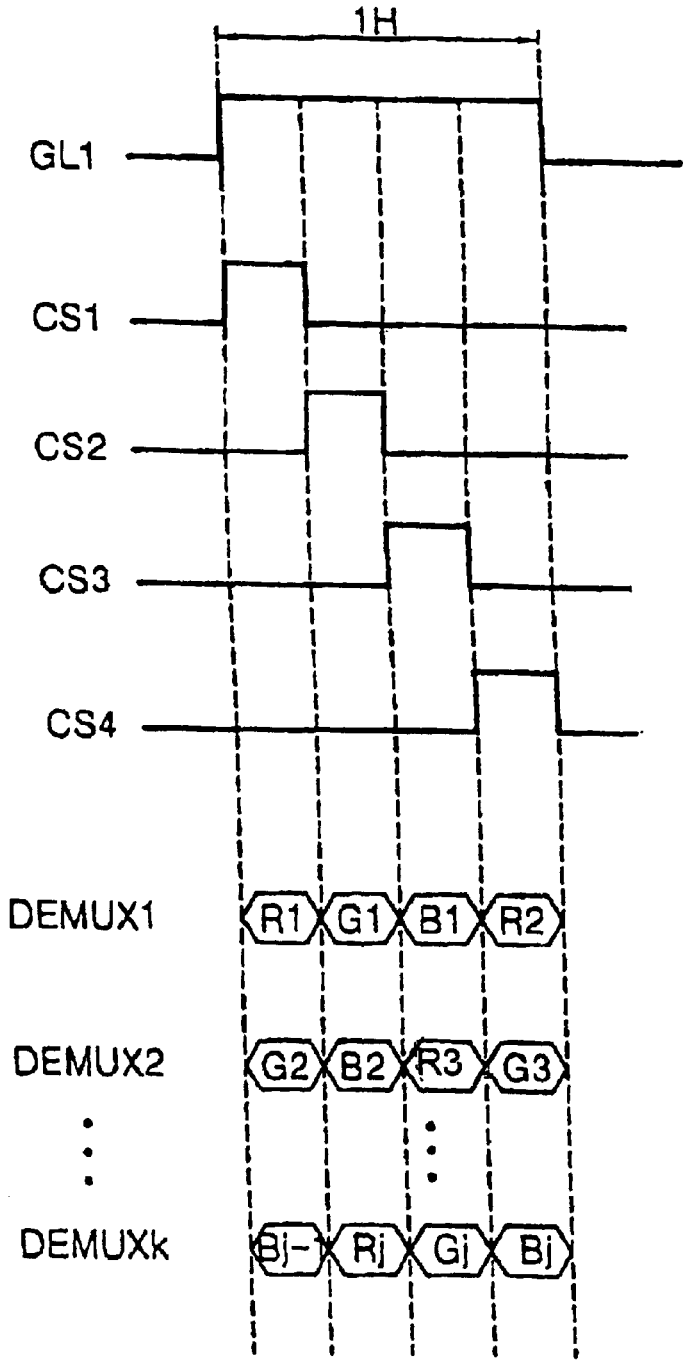
FIG.2 CONVENTIONAL ART
FIG. 2 is a waveform diagram of control signals applied to the demultiplexors shown in FIG. 1.
Figure 3:
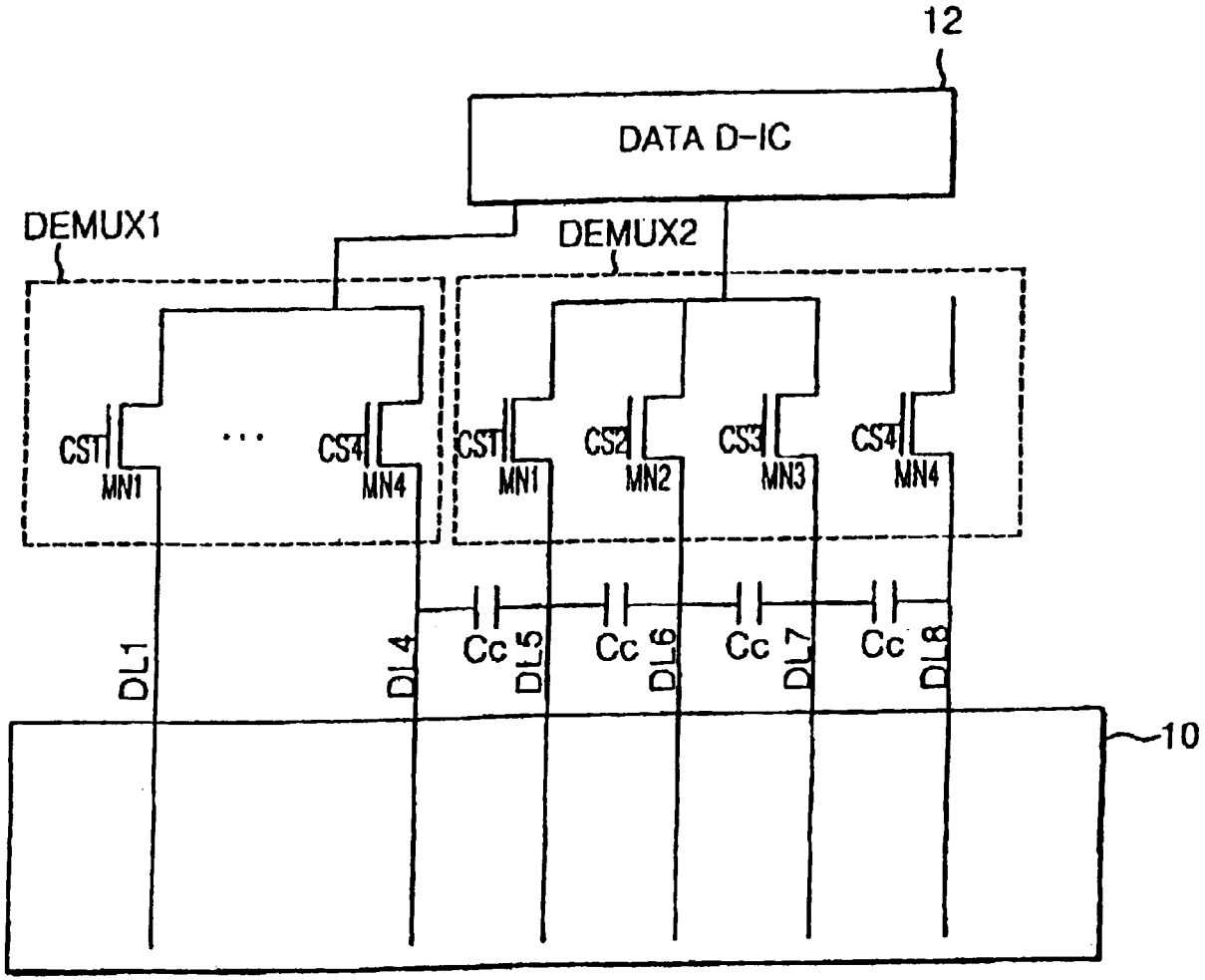
FIG.3 CONVENTIONAL ART
FIG. 3 is a block circuit diagram of the coupling capacitor formed between data lines as shown in FIG. 1.
Figure 4:
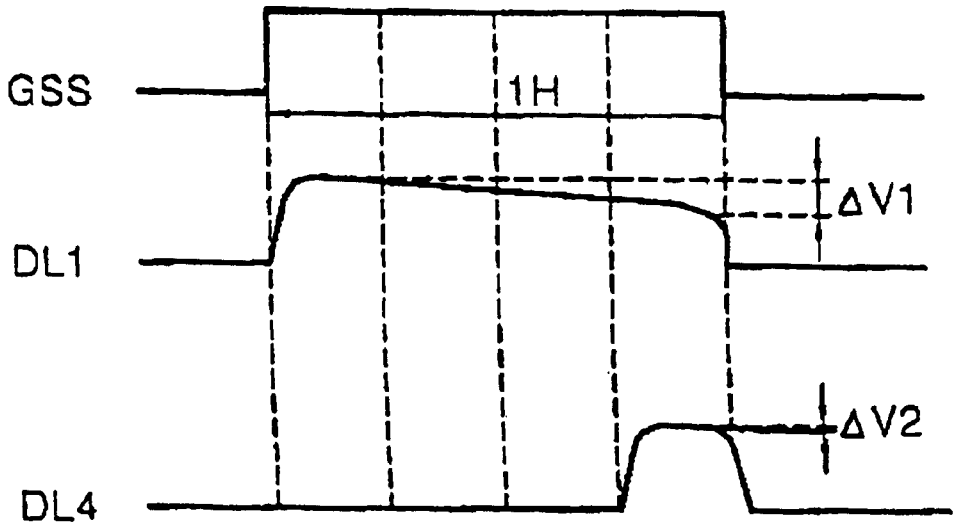
FIG. 4 CONVENTIONAL ART
FIG. 4 is a waveform diagram for showing a leakage current difference generated from the data lines on the liquid crystal display panel when the data lines are sequentially driven.
Figure 5:
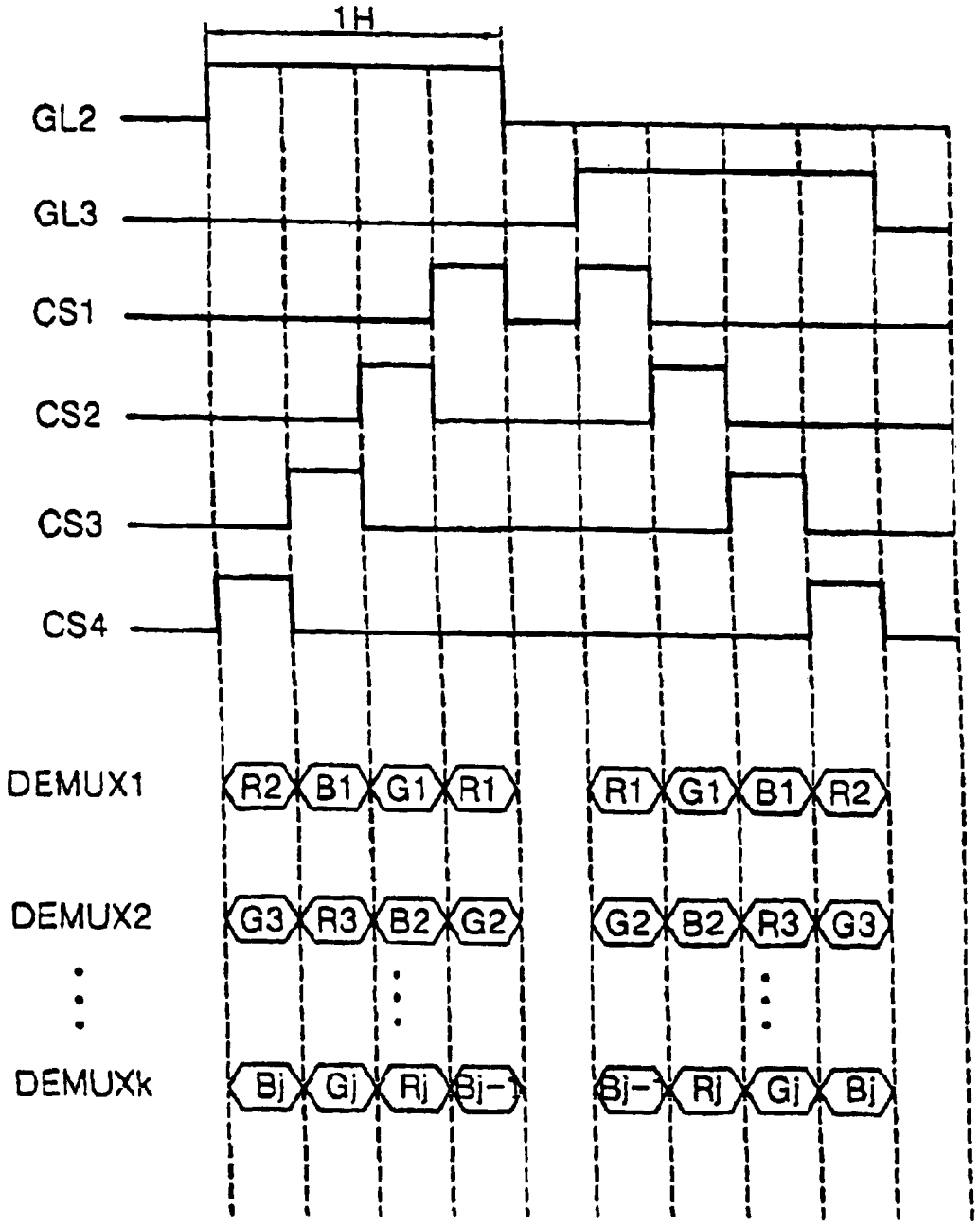
FIG. 5 is a waveform diagram for showing a method of driving a liquid crystal display according to a first embodiment of the present invention.

FIG. 5 shows a driving method for a liquid crystal display according to a first embodiment of the present invention. Such a driving method will be described in conjunction with the liquid crystal display shown in FIG. 1.

Referring to FIG. 5, in the driving method according to the first embodiment of the present invention, a sequence of control signals Cs is converted every horizontal period. In other words, when a gate scanning signal GSS is applied to a second gate line GL2, demultiplexors DEMUX1 to DEMUXk reverse-sequentially supply four data to data lines DL1 to DLn. To the contrary, when the gate scanning signal GSS is applied to a third gate line GL3, the demultiplexors DEMUX1 to DEMUXk sequentially supply four data to the data lines DL1 to DLn. In other words, in the first embodiment of the present invention, if a data is sequentially sent in a certain horizontal period, then the data is reverse-sequentially sent in the next horizontal period. To this end, a sequence of the control signals CS1 to CS4 inputted to each of the demultiplexors DEMUX1 to DEMUXk is converted every horizontal period.

More specifically, when the gate scanning signal GSS is inputted to the second gate line GL2, the first to fourth control signals CS1 to CS4 are reverse-sequentially applied to the demultiplexors DEMUX1 to DEMUXk. First, the fourth MOS transistor MN4 is turned on in a time interval when the fourth control signal CS4 has a high state, to thereby apply a green data signal G3 from the data D-IC 12 to the eighth data line DL8. Thereafter, the third demultiplexor DEMUX3 is supplied with the third control signal CS3. The third MOS transistor MN3 is turned on in a time interval when the third control signal CS3 has a high state, to thereby a red data signal R3 from the D-IC 12 to the seventh data line DL7. At this time, the green data signal G3 charged in the eighth data line DL8 by the coupling capacitor between the seventh and eighth data lines DL8 and DL7 is changed by the red data signal R3 applied to the seventh data line DL7.

After the red data signal R3 was applied to the seventh data line DL7, the second demultiplexor DEMUX2 is supplied with the second control signal CS2. In a time interval when the second control signal CS2 has a high state, the second MOS transistor MN2 is turned on, to thereby apply a blue data signal B2 from the data D-IC to the sixth data line DL6. At this time, the red data signal R3 charged in the seventh data line DL7 by the coupling capacitor Cc between the seventh and sixth data lines DL7 and DL6 is changed by the blue data signal B2 applied to the sixth data line DL6.

After the blue data signal B2 was applied to the sixth data line DL6, the first demultiplexor DEMUX1 is supplied with the first control signal CS1. In a time interval when the first control signal CS1 has a high state, the first MOS control signal is turned on, to thereby apply a green data signal from the data D-IC 12 to the fifth data line DL5. At this time, the blue data signal B2 charged in the sixth data line DL6 by the coupling capacitor Cc between the sixth and fifth data lines DL6 and DL5 is changed by the green data signal G2 applied to the fifth data line DL5.

Similarly, the green data signal G3 charged in the eighth data line DL8 also is changed by a blue data signal B3 applied to the ninth data line DL9. In other words, when the control signals CS1 to CS4 are reverse-sequentially applied, the data signal applied to the eighth data line DL8 is changed twice while the data signals applied to the seventh and sixth data lines DL7 and DL6 are changed once. On the other hand, the data signal applied to the fifth data line DL5 is not changed.

After the gate scanning signal GSS was inputted to the second gate line GL2, the gate scanning signal GSS is applied to the third gate line GL3. When the gate scanning signal GSS is inputted to the third gate line GL3, the first to fourth control signals CS1 to CS4 are sequentially applied to the demultiplexors DEMUX1 to DEMUXk. If the control signals CS1 to CS4 are sequentially applied, then the data signal applied to the fifth data line DL5 is changed twice as mentioned above. The data signals applied to the sixth and seventh data lines DL6 and DL7 are changed once. On the other hand, the data signal applied to the eighth data line DL8 is not changed.

In the driving method according to the first embodiment of the present invention, although a change frequency of the data supplied to the data lines DL1 to DLn is not uniform in each horizontal period, the data is averaged on a time basis. Accordingly, the liquid crystal display according to the first embodiment of the present invention can obtain a visually uniform picture.

Figure 6A:
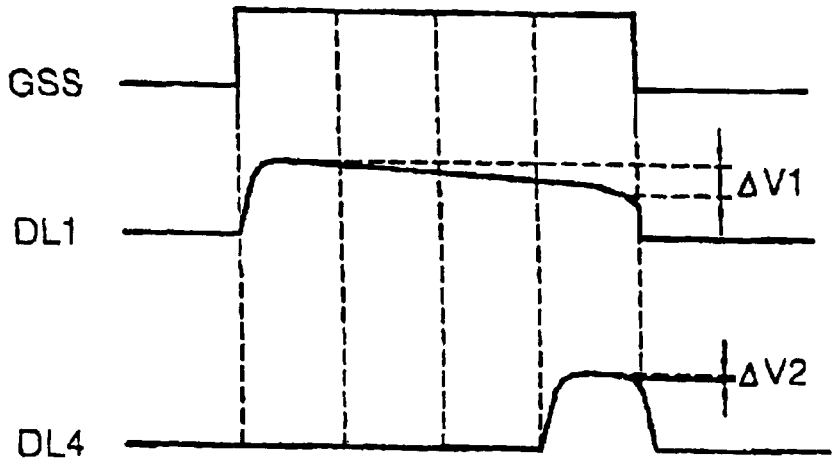
FIG. 6A and FIG. 6B are waveform diagrams for representing a leakage current generated from the data line upon driving according to the driving method shown in FIG. 5.

FIG. 6A shows a leakage current generated at the data line when a control signal is sequentially applied.

Referring to FIG. 6A, the first data line DL1 receives a first red data signal R1 from the first MOS transistor MN1 of the first demultiplexor DEMUX1 in a time interval when the first control signal CS1 has a high state. The first data line DL1 maintains the charged voltage until the falling edge of the gate scanning signal GSS. In other words, a voltage charged in the first data line DL1 is leaked for a long time from the falling edge of the first control signal CS1 until the falling edge of the gate scanning signal GSS. As a result, the first data line DL1 applies a voltage signal lower than the initially received red data signal R1 to the pixel. In other words, a voltage applied to the first data line DL1 is leaked by a voltage ΔV1.

The fourth data line DL4 receives the second red data signal R2 from the fourth MOS transistor MN4 of the first demultiplexor DEMUX1 in a time interval when the fourth control signal CS4 has a high state. The fourth data line DL4 maintains the charged voltage until the falling edge of the gate scanning signal GSS. The voltage charged in the fourth data line DL4 is leaked for a short time from the falling edge of the fourth control signal CS4 until the falling edge of the gate scanning signal GSS. As a result, a voltage applied to the fourth data line DL4 is leaked by a voltage ΔV2.

Figure 6B:
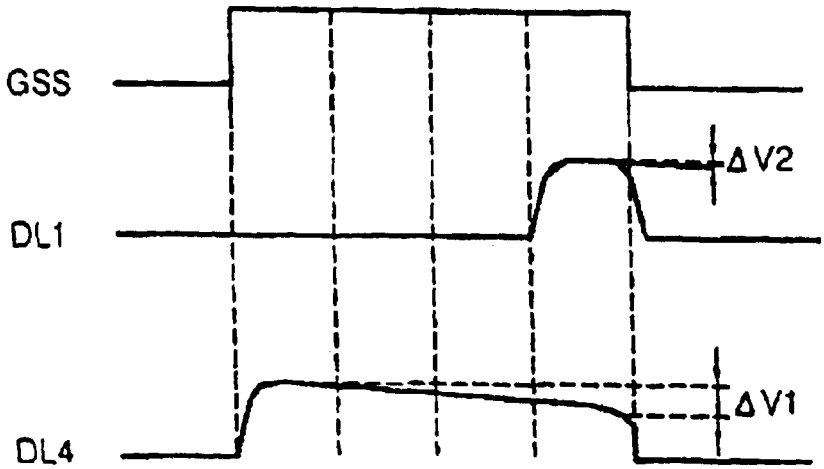

However, as shown in FIG. 6B, when the control signal is reverse-sequentially applied, the first data line DL1 is leaked by ΔV2 while the fourth data line DL4 is leaked by ΔV1. Accordingly, the present liquid crystal display has an averagely uniform leakage voltage, so that it can obtain a visually uniform picture.

Figure 7A:
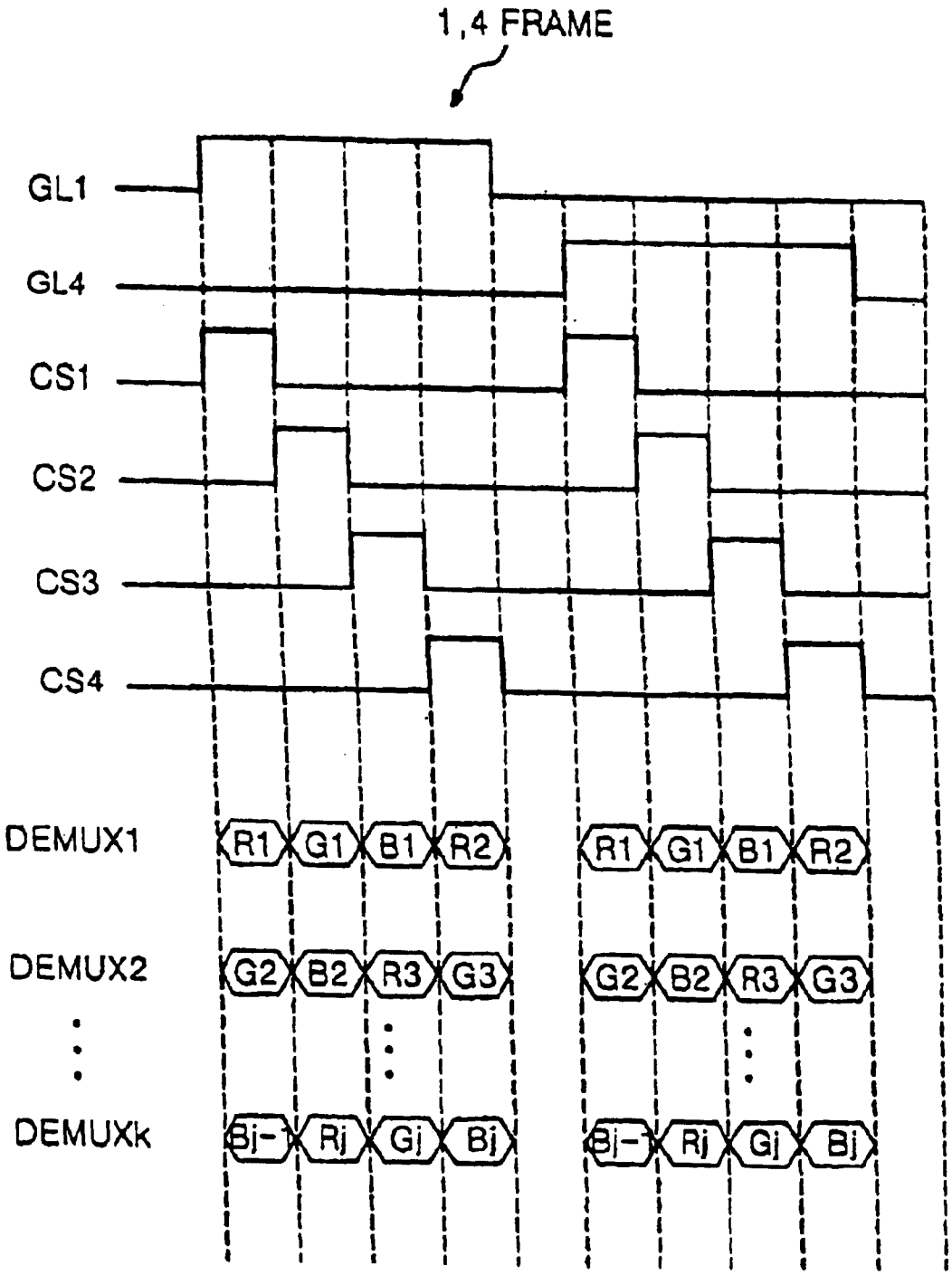
FIG. 7A and FIG. 7B are waveform diagrams for showing a method of driving a liquid crystal display according to a first embodiment of the present invention.
Figure 7B:
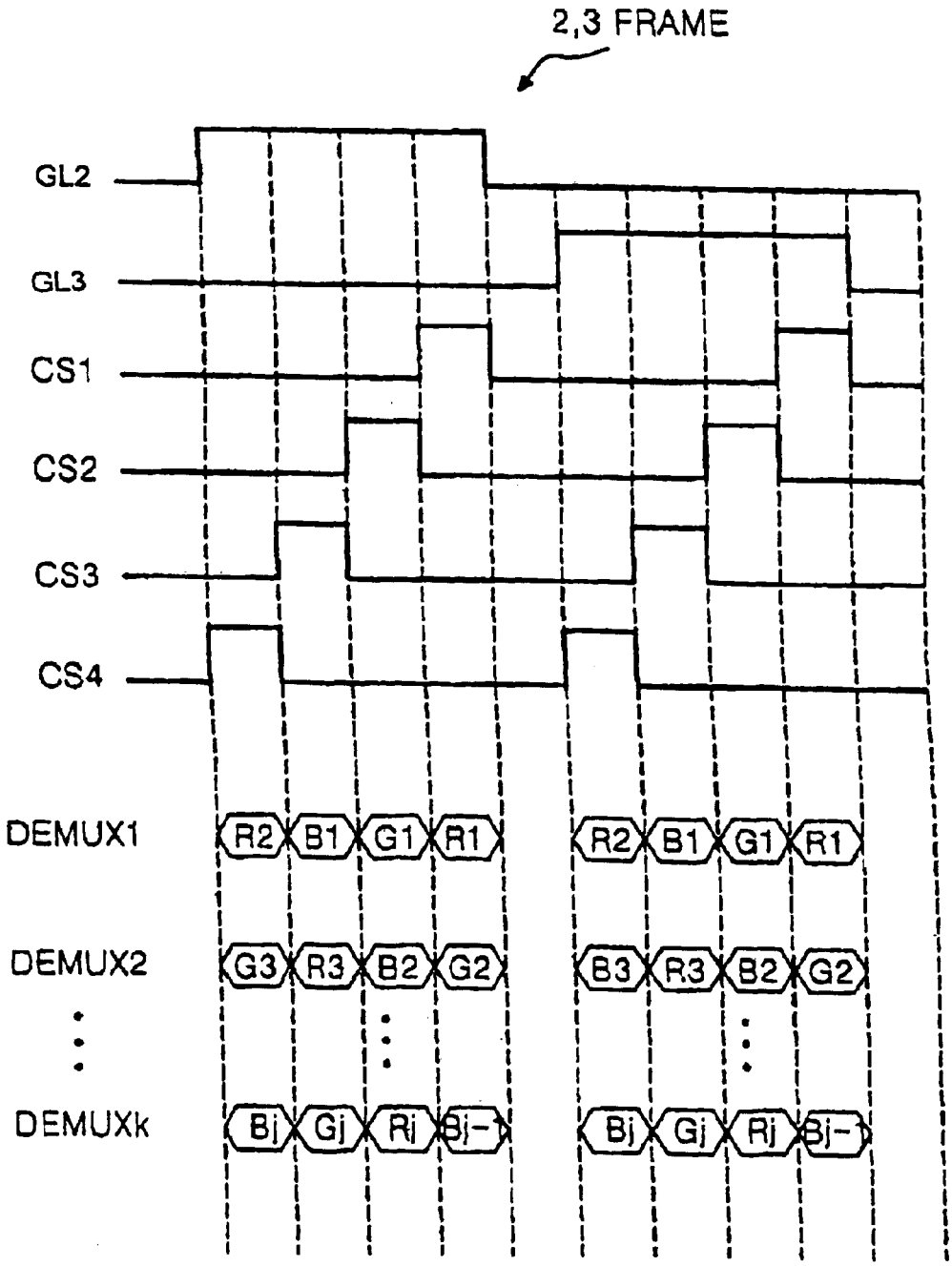

FIG. 7A and FIG. 7B are waveform diagrams for showing a driving method according to a second embodiment of the present invention.

Referring to FIG. 7A and FIG. 7B, in the driving method according to the second embodiment of the present invention, a sequence of the control signals CS1 to CS4 is changed every frame. In other words, the control signals CS1 to CS4 are sequentially applied in the first and fourth frames while being reverse-sequentially applied in the second and third frames. Accordingly, a change frequency of the data signal applied to the data lines DL1 to DLn and a leakage current becomes uniform averagely, thereby obtaining a visually uniform picture. The setting of a conversion frequency of the control signals CS1 to CS4 to four frames in the second embodiment of the present invention aims to prevent a generation of a direct current offset voltage from each pixel. In other words, when the liquid crystal display panel 10 is driven in a dot inversion, each data line DL1 to DLn is alternately supplied with a data signal having positive and negative voltage levels.

More specifically, if a positive red data signal +R is applied to the first data line DL1 in a certain horizontal period, then a negative green data signal −G is applied to the second data line DL2. In the next horizontal period, a negative red data signal −R is applied to the first data line DL1 while a positive green data signal +G is applied to the second data line DL2. Accordingly, when the control signals CS1 to CS4 are applied in a four-frame period like the second embodiment of the present invention, a sum of direct current voltages becomes zero. Thus, a direct current offset voltage is not generated.

Alternatively, in the second embodiment of the present invention, the control signals CS1 to CS4 may be reverse-sequentially applied in the first and fourth frames while being sequentially applied in the third and fourth frames.

As described above, according to the present invention, the control signals are sequentially and reverse-sequentially applied to the demultiplexors alternately every frame or every horizontal period. Accordingly, a voltage level of the data line and a conversion frequency of the data signal become averagely uniform, to thereby obtain a uniform picture.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a liquid crystal display including a plurality of data lines, a data driver for driving the data lines, and a plurality of demultiplexors arranged between the data lines and the data driver to apply a data supplied from the data driver to a desired number of data lines, said method comprising the steps of:

supplying said data to the desired number of data lines on a basis of a first sequence in a first horizontal period; and supplying said data to the desired number of data lines on a basis of a second sequence in a second horizontal period following the first horizontal period, wherein the second sequence differs from the first sequence, and wherein said data is reverse-sequentially supplied to the desired number of data lines in the second horizontal period.

2. The method as claimed in claim 1, wherein said data is sequentially supplied to the desired number of data lines in the first horizontal period.

3. The method as claimed in claim 1, wherein a scanning signal is applied to any one of a plurality of gate lines arranged in a direction crossing the data lines in said horizontal period.

4. The method as claimed in claim 1, wherein each of the demultiplexors includes a desired number of switching devices, which are sequentially supplied with a control signal in said first horizontal period.

5. The method as claimed in claim 1, wherein each of the demultiplexors includes a desired number of switching devices, which are reverse-sequentially supplied with a control signal in said second horizontal period.

6. A method of driving a liquid crystal display including a plurality of demultiplexors that are driven every frame and arranged between a plurality of data lines and a data driver to apply a data supplied from the data driver to a desired number of data lines, said method comprising the steps of:

supplying said data to the desired number of data lines on a basis of a first sequence in the (4i+1) th and (4i+4) th frames (wherein i is an integer); and supplying said data to the desired number of data lines on a basis of a second sequence in the (4i+2) th and (4i+3) th frames, wherein the second sequence differs from the first sequence, and wherein said data is reverse-sequentially supplied to the desired number of data lines in the (4i+2) th and (4i+3) th frames.

7. The method as claimed in claim 6, wherein said data is sequentially supplied to the desired number of data lines in the (4i+1) th and (4i+4) th frames.

8. The method as claimed in claim 6, wherein each of the demultiplexors includes a desired number of switching devices, which are sequentially supplied with a control signal in the (4i+1) th and (4i+4) th frames.

9. The method as claimed in claim 6, wherein each of the demultiplexors includes a desired number of switching devices, which are reverse-sequentially supplied with a control signal in the (4i+2) th and (4i+3) th frames.

10. A method of driving a liquid crystal display including a plurality of demultiplexors that are driven every frame and arranged between a plurality of data lines and a data driver to apply a data supplied from the data driver to a desired number of data lines, said method comprising the steps of:

supplying said data to the desired number of data lines on a basis of a first sequence in the (4i+1) th and (4i+4) th frames (wherein i is an integer); and supplying said data to the desired number of data lines on a basis of a second sequence in the (4i+2) th and (4i+3) th frames, wherein the second sequence differs from the first sequence, and wherein said data is reverse-sequentially supplied to the desired number of data lines in the (4i+1) th and (4i+4) th frames.

11. The method as claimed in claim 10, wherein said data is sequentially supplied to the desired number of data lines in the (4i+2) th and (4i+3) th frames.

12. The method as claimed in claim 10, wherein each of the demultiplexors includes a desired number of switching devices, which are reverse-sequentially supplied with a control signal in the (4i+1) th and (4i+4) th frames.

13. The method as claimed in claim 10, wherein each of the demultiplexors includes a desired number of switching devices, which are sequentially supplied with a control signal in the (4i+2) th and (4i+3) th frames.

14. A liquid crystal display device including a plurality of demultiplexors arranged between a plurality of data lines and a data driver to apply a data supplied from the data driver to a desired number of data lines, said device comprising:

switching devices a desired number of which are included in each demultiplexor and each of which is connected to one data line; and control means for controlling the switching devices such that said data is sequentially distributed to the desired number of data lines in a first horizontal period and said data is reverse-sequentially distributed to the desired number of data lines in a second horizontal period following the first horizontal period.

15. A liquid crystal display device including a plurality of demultiplexors that are driven every frame and arranged between a plurality of data lines and a data driver to apply a data supplied from the data driver to a desired number of data lines, said device comprising:

switching devices a desired number of which are included in each demultiplexor and each of which is connected to one data line; and control means for controlling the switching devices such that said data is sequentially distributed to the desired number of data lines on a basis of first sequence in the (4i+1) th and (4i+4) th frames (wherein i is an integer) and said data is reverse-sequentially distributed to the desired number of data lines on a basis of second sequence in the (4i+2) th and (4i+3) th frames.

16. The device as claimed in claim 15, wherein the control means controls the switching device such that said data is sequentially distributed to the desired number of data lines in the (4i+1) th and (4i+4) th frames and such that said data is reverse-sequentially distributed to the desired number of data lines in the (4i+2) th and (4i+3) th frames.

17. The device as claimed in claim 15, wherein the control means controls the switching device such that said data is reverse-sequentially distributed to the desired number of data lines in the (4i+1) th and (4i+4) th frames and such that said data is sequentially distributed to the desired number of data lines in the (4i+2) th and (4i+3) th frames.

* * * * *